US005899845A

United States Patent [19]

Kohlstette et al.

[11] Patent Number: 5,899,845

[45] Date of Patent: May 4, 1999

[54] METHOD OF AND DEVICE FOR FILLING AN AUTOMATICALLY DISCHARGING CENTRIFUGE DRUM

[75] Inventors: Werner Kohlstette, Oelde; Marie-Theres Sedler, Wadersloh; Gottfried Heinze, Ennigerloh, all of Germany

[73] Assignee: Westfalia Separator Aktiengesellschaft, Oelde, Germany

[21] Appl. No.: 08/930,309

[22] PCT Filed: May 15, 1996

[86] PCT No.: PCT/EP96/02076

§ 371 Date: Oct. 8, 1997

§ 102(e) Date: Oct. 8, 1997

[87] PCT Pub. No.: WO96/38230

PCT Pub. Date: Dec. 5, 1996

[30] Foreign Application Priority Data

May 30, 1995 [DE] Germany ..... 195 19 693

[51] Int. Cl.[6] ..... B04B 1/08

[52] U.S. Cl. ..... 494/37; 494/70

[58] Field of Search ..... 494/23, 27–30, 494/37, 56, 68–73

[56] References Cited

U.S. PATENT DOCUMENTS

| | | | |
|---|---|---|---|
| 1,426,959 | 8/1922 | Collins | 494/70 |
| 2,456,347 | 12/1948 | Vogel | 494/70 |
| 2,468,632 | 4/1949 | Vogel | 494/70 |
| 4,614,598 | 9/1986 | Zettier et al. | 494/70 |

FOREIGN PATENT DOCUMENTS

| | | |
|---|---|---|
| 2294755 | 7/1976 | France . |
| 3627826 | 10/1987 | Germany . |
| 3716035 | 12/1988 | Germany . |
| 451826 | 5/1968 | Switzerland . |

*Primary Examiner*—Charles E. Cooley

*Attorney, Agent, or Firm*—Sprung Kramer Schaefer & Briscoe

[57] ABSTRACT

A centrifuge drum and a method of filling an automatically discharging centrifuge drum with a mixture of liquids that is to be separated. The mixture is introduced through an intake pipe and a header. The header's intake section communicates with a stack of disks through openings in the header's base. The base is provided with radial supply channels. Channels at the center of the stack divert the separated lighter liquid phase into a diversion chamber and channels at the periphery of the stack divert the separated heavier liquid phase into another diversion chamber. The drum is charged with an auxiliary liquid obtained from a lower section of the base up to a radially inward level that covers the intake openings into the supply channel in an upper section of the base of the foot. The mixture is then introduced at full power through both sections of the base.

5 Claims, 1 Drawing Sheet

METHOD OF AND DEVICE FOR FILLING AN AUTOMATICALLY DISCHARGING CENTRIFUGE DRUM

BACKGROUND OF THE INVENTION

The present invention concerns a method of filling an automatically discharging centrifuge drum with a mixture of liquids that is to be separated. The mixture is introduced through an intake pipe and a header. The header's intake section communicates with a stack of disks through openings in the header's base. The base is provided with radial supply channels. Channels at the center of the stack divert the separated lighter liquid phase into a diversion chamber, and channels at the periphery of the stack divert the separated heavier liquid phase into another diversion chamber.

The invention also concerns an automatically discharging centrifuge drum of the type having an intake pipe and a header with an intake section that communicates through openings in the base of the header with a stack of disks, wherein the base is provided with radial supply channels, wherein channels at the center of the stack can divert the lighter liquid phase of the separated mixture into a diversion chamber, and wherein other channels at the periphery of the stack divert the heavier liquid phase into another diversion chamber.

A centrifuge drum for separating mixtures of liquids is known from German 2 313 669 C3 for example. The supply channels in this drum are created by ribs below the base of the header that extend into the center of the intake section. The ribs initiate spontaneous acceleration on the part of the incoming mixture to the same angular speed as that of the drum. The unavoidable impact can be detrimental to sensitive mixtures.

Such mixtures can be particularly stressed when the ribs or intake openings are not covered by the liquid. Once the ribs are below the level of the liquid, entrainment will be as extensively careful as possible due to liquid friction. Such a drum can of course be designed to ensure that the ribs or openings will be covered by liquid during actual operation, but they will still be uncovered while the drum is being charged at the commencement of the separation process or once the drum has discharged, when they will have the aforesaid deleterious effect on the product.

This situation is particularly unacceptable with very precious and impact-sensitive products, from the separation of blood plasma for example. In this case the discharged plasma will remain tinged with red for 30 seconds, a sign of undesirable hemolysis due to impact on the cells.

SUMMARY OF THE INVENTION

The object of the present invention is a method of charging a centrifuge drum wherein the mixture of liquids will not be detrimentally affected by channels or ribs not covered by liquid.

This object is attained in a method in accordance with the present invention wherein, in the following sequence, a) the drum is charged with an auxiliary liquid obtained from a lower section of the base of the header up to a level radially inward of the intake openings into that section, b) the mixture of liquids is introduced at reduced power through the lower section of the base up to a radially inward level that covers the intake openings into the supply channel in an upper section of the base of the foot, and c) the mixture is introduced at full power through both sections of the base.

The initially introduced auxiliary liquid will cover the intake openings into the supply channel in the lower section of the base of the header before the impact-sensitive material is introduced into that section at reduced power and gently accelerated. The lower section will simultaneously charge to a liquid level radially inward of the intake openings into the supply channel in the upper section. The level of liquid in the upper section will simultaneously be displaced radially inward until it covers the intake openings in that section. Since all the intake openings in the header will now be covered with liquid, separation can commence at full power with no detriment to the product.

The auxiliary liquid in one advantageous embodiment of the present invention is saltwater. This medium has been particularly proven for separating blood.

The object of the present invention is also attained in a centrifuge drum for carrying out the method. The drum has the base divided into an upper section and a lower section that communicate at the periphery and wherein intake openings in the supply channels in the upper section of the base are situated radially inward of intake openings in the supply channels in the lower section of the base and the intake pipe opens into the lower section. Simultaneous displacement of the levels of liquid in the upper and lower sections is enabled by the peripheral communication between them.

The intake openings in the lower section in one advantageous embodiment of the drum are situated at a diameter $D_2$ that is longer than the diameter $D_1$ at the discharge from the second diversion chamber. Auxiliary liquid discharging from the second diversion chamber is, due to the communicating action between diameter $D_1$ and diameter $D_2$, an indication that the intake openings in the lower section are covered.

The intake openings in the upper section in another advantageous embodiment are situated at a diameter $D_4$ that is longer than the diameter $D_3$ at the discharge from the first diversion chamber. Separated liquid discharging from the first diversion chamber is for the same reason an indication that the intake opening in the upper section are covered.

One embodiment of a centrifuge drum in accordance with the present invention will now be specified along with the method in accordance with the present invention with reference to the accompanying drawing.

DETAILED DESCRIPTION OF THE INVENTION

Figure 2:
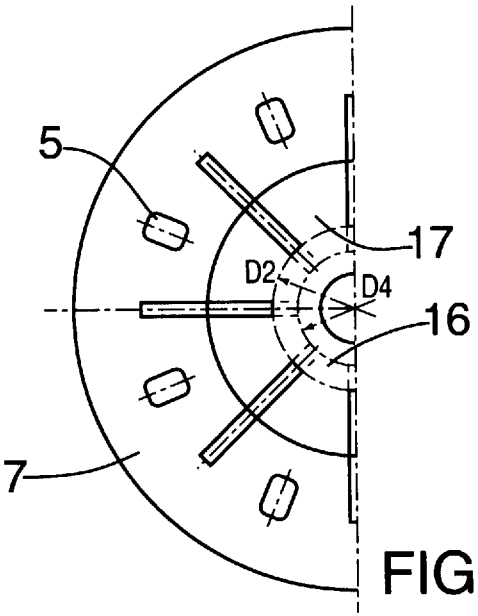
FIG. 2 is a view at II in FIG. 1.
Figure 1:
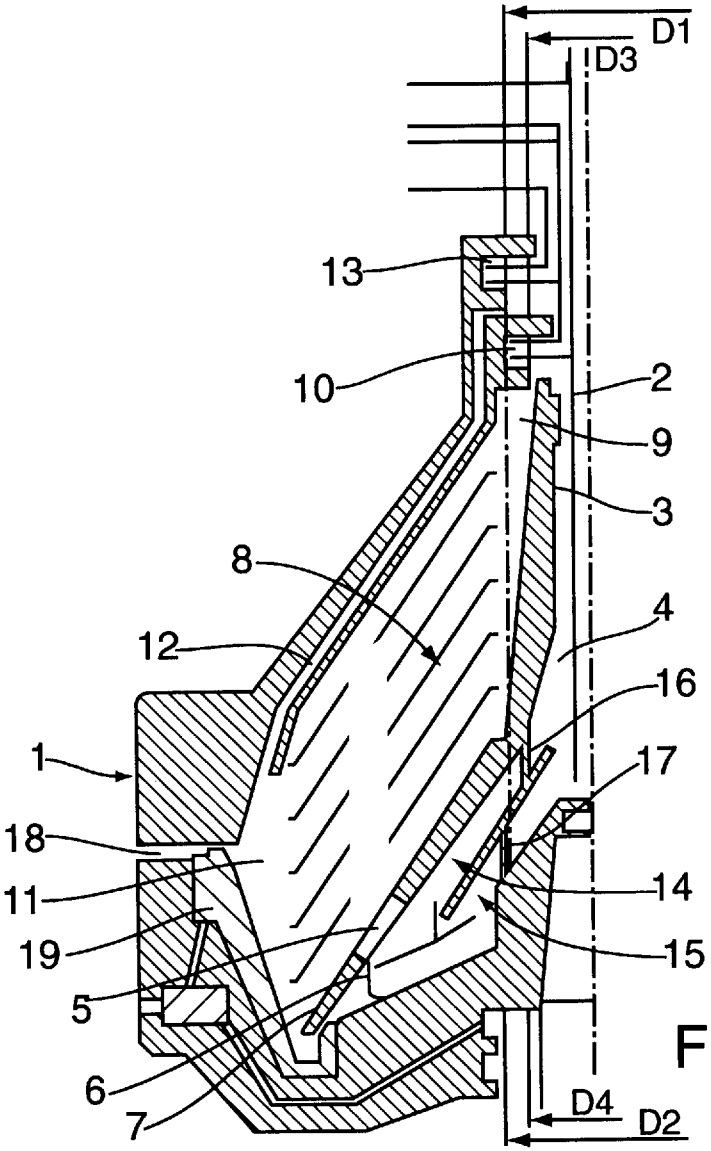
FIG. 1 is a cross section of a centrifuge drum according to the present invention for carrying out the method according to the present invention.

The centrifuge drum 1 illustrated in FIGS. 1 and 2 has an intake pipe 2 and a header 3 that communicate through an intake section 4 and through openings 5 in the base 7 of the header with a stack 8 of disks. Base 7 is provided with radial supply channels 6. Channels 9 at the center of stack 8 divert the lighter liquid phase of the separated mixture into a diversion chamber 10. Other channels 12 at the periphery of stack 8 divert the heavier liquid phase into another diversion chamber 13. Base 7 is divided into an upper section 14 and a lower section 15. These two sections communicate in the vicinity of openings 5. Intake openings 16 in the supply channels 6 in the upper section 14 of the base 7 of header 3 are situated radially inward of intake openings 17 in the supply channels 6 in the lower section 15 of the base. Intake pipe 2 opens into lower section 15. Separated solids are extracted through openings 18 at the periphery of drum 1 and can be opened and closed by a hydraulically actuated cylindrical valve 19.

Drum 1 is initially charged with an auxiliary liquid conveyed into second diversion chamber 13 through intake pipe 2, the lower section 15 of base 7, a mixture-separating compartment 11, and the channels 12 at the periphery of stack 8 and out at diameter $D_1$. A liquid level becomes established at this diameter, which is shorter than a diameter $D_2$ in the vicinity of the intake openings 17 into lower section 15, due to the communicating action, which also exists in the vicinity of base 7. Intake openings 17 will accordingly be covered by the auxiliary liquid. The mixture, which is subsequently conveyed to lower section 15, will accordingly be accelerated by contact with the auxiliary liquid. To prevent lower section 15 from overflowing, it is now charged at lower power, and the liquid levels in both upper section 14 and first diversion chamber 10, the chamber that diverts the lighter liquid phase, will be simultaneously displaced radially inward by the separated lighter liquid phase to a diameter $D_3$ at the discharge from first diversion chamber 10. Since diameter $D_3$ is smaller than the diameter $D_4$ in the vicinity of the intake openings 16 into upper section 14, openings 16 will also be covered with liquid. Separation can now be carried out at full power without detriment to the product.

Due to the radially inward situation of the intake openings 16 into upper section 14, they will exert a considerably more powerful liquid pressure, and upper section 14 will dictate the drum's output. The main purpose of lower section 15 is to allow drum 1 to be charged without impact. The drum is charged in this way subsequent to every discharge by way of solids-extraction openings 18.

We claim:

1. A method of filling an automatically discharging centrifuge drum with a mixture of liquids that is to be separated, comprising the steps of:

providing a centrifuge drum having an intake pipe and a header having an intake section in communication with a stack of disks through openings in a base of the header, wherein the base of the header is divided into an upper section and a lower section that communicate in the vicinity of the openings and wherein the lower section has radial supply channels and the upper section has radial supply channels, wherein channels at a center of the stack of disks divert separated lighter liquid phase into a first diversion chamber, wherein channels at a periphery of the stack of disks divert the separated heavier liquid phase into a second diversion chamber, wherein intake openings in the radial supply channels in the upper section of the base of the header are situated radially inward of intake openings in the radial supply channels in the lower section of the base of the header and the intake pipe opens into the lower section, charging the drum with an auxiliary liquid obtained from the lower section of the base of the header up to a level radially inward of the intake openings into the lower section, thereafter introducing the mixture of liquids at reduced power through the lower section of the base of the header up to a radially inward level that covers the intake openings into the radial supply channels in the upper section of the base of the header, and then introducing the mixture at full power through both sections of the base of the header.

2. The method as in claim 1, wherein the auxiliary liquid is saltwater.

3. An automatically discharging drum comprising: an intake pipe and a header with an intake section that communicates through openings in a base of the header with a stack of disks, wherein the base of the header is divided into an upper section and a lower section that communicate at a periphery and wherein the lower section has radial supply channels and the upper section has radial supply channels, channels at the center of the stack of disks for diverting a lighter liquid phase of a separated mixture into a first diversion chamber, and other channels at a periphery of the stack of disks for diverting a heavier liquid phase into a second diversion chamber, wherein intake openings in the radial supply channels in the upper section of the base of the header are situated radially inward of intake openings in the radial supply channels in the lower section of the base of the header and the intake pipe opens into the lower section and wherein the intake openings in the lower section are situated radially outward of a diameter at a discharge from the second diversion chamber.

4. The centrifuge drum as in claim 3, wherein the intake openings in the upper section are situated radially outward of a diameter at a discharge from the first diversion chamber.

5. An automatically discharging drum comprising: an intake pipe and a header with an intake section that communicates through openings in a base of the header with a stack of disks, wherein the base of the header is divided into an upper section and a lower section that communicate at a periphery and wherein the lower section has radial supply channels and the upper section has radial supply channels, channels at the center of the stack of disks for diverting a lighter liquid phase of a separated mixture into a first diversion chamber, and other channels at a periphery of the stack of disks for diverting a heavier liquid phase into a second diversion chamber, wherein intake openings in the radial supply channels in the upper section of the base of the header are situated radially inward of intake openings in the radial supply channels in the lower section of the base of the header and the intake pipe opens into the lower section and wherein the intake openings in the upper section are situated radially outward of a diameter at a discharge from the first diversion chamber.

* * * * *